United States Patent [19]

Koiwa et al.

[11] 3,935,925

[45] Feb. 3, 1976

[54] HORN UNIT FOR A SPEAKER

[75] Inventors: Kenji Koiwa; Makoto Kohashi, both of Yokohama, Japan

[73] Assignee: Hitachi, Ltd., Japan

[22] Filed: Nov. 2, 1973

[21] Appl. No.: 412,154

[30] Foreign Application Priority Data

Nov. 6, 1972 Japan ..... 47-110331

[52] U.S. Cl. ..... 181/192; 181/195

[51] Int. Cl.[2] ..... G10K 11/00

[58] Field of Search .... 181/27 R, 31 R, 31 B, 27 C, 181/27 D, 192, 195

[56] References Cited

UNITED STATES PATENTS

| | | | |
|---|---|---|---|
| 673,396 | 5/1901 | Hogan | 181/27 C |
| 1,835,739 | 12/1931 | Abrahams | 181/27 R |
| 1,918,366 | 7/1933 | Abrahams | 181/27 R |

*Primary Examiner*—Stephen J. Tomsky
*Attorney, Agent, or Firm*—Paul M. Craig, Jr.

[57] ABSTRACT

A horn speaker having wide directional characteristics in accordance with the present invention provides a horn having a horn wall the shape of which is formed by connecting a plurality of curves having different flaring constants. The flaring constant of the curve forming a mouth portion of the horn wall is selected so as to be greater than that of the curve forming a throat portion thereof. The mouth portion of the horn wall is shaped so as to have a flaring angle which is formed by the curve at the mouth portion and has no abrupt variation of angle to a baffle plate. The curve at the mouth portion is connected with the curve at the horn wall nearer to the throat portion and having the flaring constant different therefrom at a point at which the differential coefficients of the respective curves substantially coincide with each other.

7 Claims, 6 Drawing Figures

HORN UNIT FOR A SPEAKER

BACKGROUND OF THE INVENTION

1. Field of the Invention

The present invention relates to a horn speaker, and more particularly to a horn speaker having a horn wall the shape of which is improved so as to have wide directional characteristics.

2. Description of the Prior Art

In general, a horn speaker having a cut-off frequency is used over a frequency band given by the following expression $$kR \geqq \sqrt{2} \tag{1}$$

where $k$ is the wavelength constant and R is the radius of the mouth portion of a horn, taking into account the fact that acoustic impedance as viewed from the throat portion of a horn must have a level great enough for a speaker. For this reason, it is known that an acoustic wave emitted from the horn has directional characteristics. Accordingly, the horn speaker indeed has the advantage of high efficiency as compared with a direct radiator loudspeaker, but is inferior thereto from the view-point of directional characteristics.

It is well known that the horn unit has its directional characteristics determined depending substantially on the mouth diameter thereof as in the direct radiator loud-speaker, therefore, wide directional characteristics are obtained by making the mouth diameter as small as possible. It is, however, necessary to provide the horn which discontinuously and abruptly varies in section to an area extending through free space because the decrease in mouth diameter requires the shortened horn and reduced flaring angle. For this reason reflections occur at the mouth portion of the horn, and this results in fluctuation of frequency characteristics of output acoustic pressure. Thus, the decrease in mouth diameter results in deterioration in characteristics of the output acoustic pressure, so that the consideration is to be given that a flaring angle at the mouth portion (hereinafter referred as to a flaring angle $\theta_M$) is restricted to about 45° when the horn is to be shortened and decreased in diameter. The reason is that the flaring angle $\theta_M$ above 45° usually leads to a reflection factor less than 10% at the mouth portion over the range of $kR \geqq 2$ in the example of an exponential horn in wide use on the assumption of $$R = 2/m \tag{2}$$

where $R$ is the radius of the horn mouth and $m$ is the flaring constant. It is, however, inevitable that when the flaring angle $\theta_M$ of 45° causes the cut-off frequency to take place at $kR = 1$, the directional characteristics is sharpened over a practical frequency band.

FIG. 1 is a typical cross-section showing a conventional horn. The conventional horn is designed so as to have the cross-section smoothly varied with a given function and is cut-off at a suitable distance at which an influence of reflection at the mouth portion thereon can be neglected. For example, in the exponential horn, the horn has the cross-section designed in accordance with a relation $$S(x) = S_o e^{mx} \tag{3}$$

and the flaring angle $\theta_M$ is selected in proximity of 45°, where $S(x)$ is the sectional area of the horn measured at a distance of $x$, $S_o$ is the sectional area of the throat portion, $e$ is the base of a natural logarithm, and $m$ is the flaring constant.

FIG. 2 shows an equiphase surface and a constant acoustic pressure surface of the acoustic wave propagating in the exponential horn having the flaring angle $\theta_M$ of 45°. These characteristics are symmetrical with respect to the central line, so that they are shown at only one side of the center. The equiphase surfaces $a$, $b$ are shown by solid lines and the constant acoustic pressure surfaces $a'$, $b'$ are shown by dotted lines. The shape of the equiphase surface $a$ substantially coincides with that of the constant acoustic pressure surface a within an area of the horn having the flaring angle of about 27°. However, in the proximity of the mouth portion the shape of the equiphase surface $b$ deviates greatly from that of the constant acoustic pressure $b'$. This shows that the acoustic wave is strongly emitted in the proximity of the center with the strong directional characteristics.

For improvement of such directional characteristics of the horn, there have conventionally been proposed widely used systems such as a multicellular horn in which several horns are arranged with suitable orientations or a system in which a diffuser (acoustic lens) is disposed in the front of the horn. These systems have the drawback that the speaker has its elements increased in number with high cost.

SUMMARY OF THE INVENTION

An object of the present invention is to provide a novel and useful horn unit for use in a horn speaker.

Another object of the present invention is to provide a horn unit for use in a horn speaker having wide directional characteristics.

A further object of the present invention is to provide a horn unit which provides wide directional characteristics without using any accessories.

A still further object of the present invention is to provide a horn unit which provides a wide directional characteristics without disturbing output characteristics of acoustic pressure.

A horn unit according to the present invention is shaped to have a configuration not determined by a single function over an area extending from the throat portion to the mouth portion, but is shaped to be divided into configurations determined by a plurality of functions. The horn has its mouth portion shaped with a great curvature without making large the diameter of the throat portion so that a horn wall may be brought into smooth connection with a baffle plate.

The present invention is based on the fact that the acoustic wave propagating in the horn has not been found to be plane wave by actual measurement although assumed to be so in the theory of a speaker but found to be a wave front having a projection in the direction of the mouth portion and intersecting at right angles with the horn wall as the equiphase surface and the constant acoustic pressure surface of the acoustic wave intersect therewith.

The horn having the configuration according to the present invention provides the wide directional characteristics without disturbing any output characteristics of the acoustic pressure because the acoustic wave in the horn approaches a complete sphere. Accordingly, the horn according to the present invention improves the directional characteristics to a great extent as compared with the conventional horns only by altering the horn in shape without using any multicellular horn or diffuser.

DESCRIPTION OF THE PREFERRED EMBODIMENT

Figure 1:
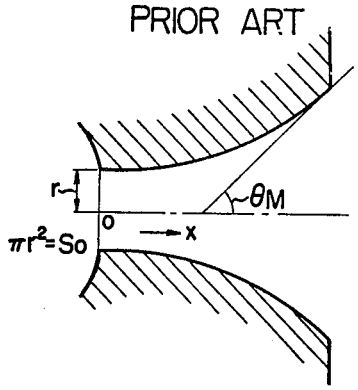
FIG. 1 PRIOR ART
FIG. 1 is a cross-sectional view of a conventional horn.
Figure 3:
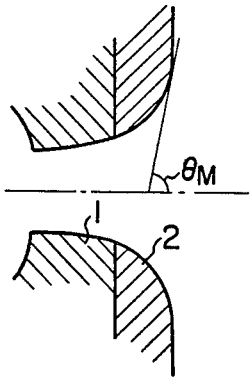
FIG. 3 is a cross-sectional view showing one embodiment of the present invention.

FIG. 3 is a cross-sectional view showing an embodiment of the present invention.

In this embodiment, a horn unit is divided into two portions, a horn 1 and a horn 2. The horn 1 is shaped by a function and the range of the flaring angle at the connecting area is so selected that the equiphase surface and constant acoustic pressure surface of the acoustic wave propagating in the horn coincide substantially. That is, the flaring angle ranges within 35° and, for example, can be 30° at the connecton with horn 2. The horn 2 has a flaring constant much greater than the horn 1 and is arranged so that the tip end of the horn 1 is brought into smooth connection with the horn wall of the horn 2. In other words, the horns are connected with each other at a portion where the differential coefficient of a curve forming configuration of one horn at a point connecting with the other horn is equal to that of a curve forming configuration of the other horn. Further, the mouth portion of the horn 2 is shaped with the sufficiently great flaring angle $\theta_M$ above 60° so as to be brought into relatively smooth connection with the baffle plate. This arrangement permits the reflection factor at the mouth portion of the horn 2 to be reduced as compared with the conventional horns.

The horns 1 and 2 may be formed separately and then assembled, or may be formed integral with the configuration of the horn wall changed halfway.

Figure 2:
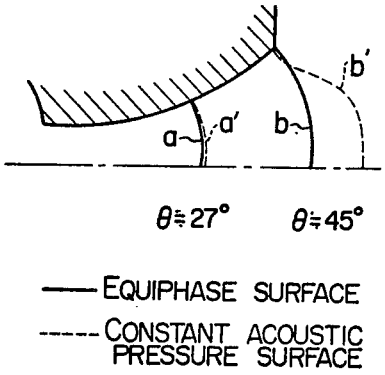
FIG. 2 PRIOR ART
FIG. 2 is a view showing the equiphase surface and constant acoustic pressure surface of an output acoustic wave in the conventional horn.
Figure 4:
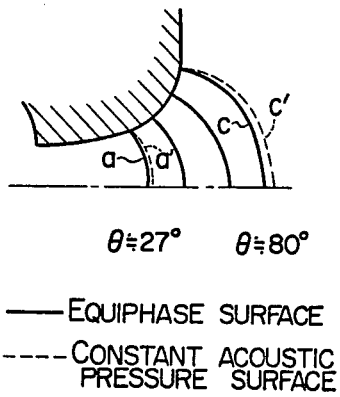
FIG. 4 is a view showing the equiphase surface and constant acoustic pressure surface of the output acoustic wave in the horn shown in FIG. 3.

FIG. 4 is a view showing one form of the equiphase surface and constant acoustic pressure surface in the horn unit according to the present invention. Symbols $a$, $c$ indicate the equiphase surface and $a'$, $c'$ indicate the constant acoustic pressure surface. Within a position of the horn where the flaring angle is about 27°, the equiphase surface $a$ and the constant acoustic pressure surface $a'$ are the same as those shown in FIG. 2. At the mouth portion having the flaring angle of 80°, on the other hand, the equiphase surface $c$ differs less from the constant acoustic pressure surface $c'$ than that of the conventional horn. Further, the shape of the wave surface approaches the sphere without disturbance as compared with the conventional one.

In the conventional horn unit, the control of the wave surface was not taken into positive consideration from the viewpoint of the directional characteristics. The cutting of the horn at the flaring angle of about 45° led to the fact that the horn wall intersected at a great angle with the baffle plate with result of the disturbance of the equiphase surface and constant acoustic pressure surface at the mouth portion.

On the other hand, the horn unit according to the present invention includes the two horns having the different flaring constants, for example, with the flaring constant $m$ in the exponential horn at a position extending from the throat portion to mouth portion as shown in FIG. 3. The wave surface positively approaches the sphere as it is propagated in the horn because the horn 2 located near the mouth portion has a greater flaring constant. The horn according to the present invention permits the flaring angle to be made large with the same diameter as that of the conventional horn with the result of the substantially negligible disturbance of the wave surface at the mouth portion as compared with the conventional horn.

Figure 5:
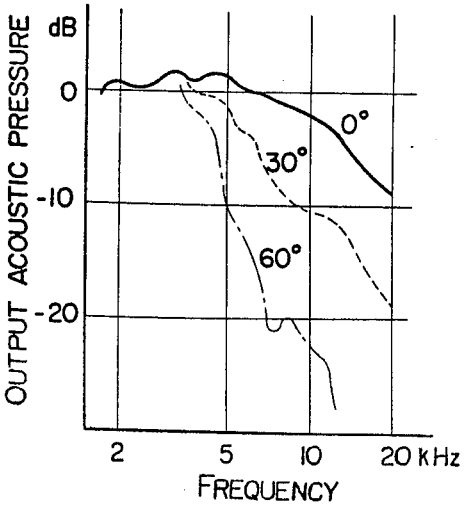
FIG. 5 PRIOR ART
FIG. 5 is a graph showing frequency characteristics of the output acoustic wave representative of directional characteristics of the conventional horn.
Figure 6:
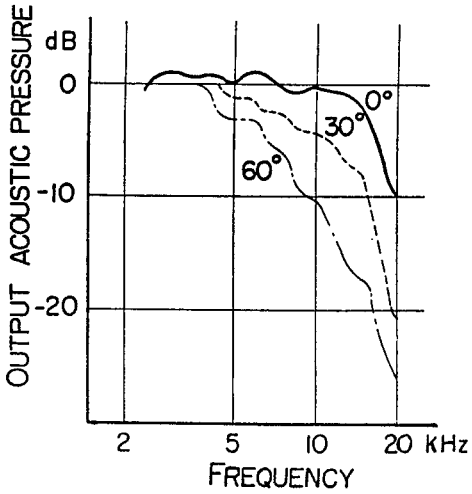
FIG. 6 is a graph showing frequency characteristics of the output acoustic wave representative of directional characteristics of the horn according to the present invention.

An example of measurement of the directional characteristics in the horn according to the present invention is shown in FIGS. 5 and 6 in comparison with the conventional ones. FIG. 5 shows the result of measurement in the conventional exponential horn with the diameter of 6 centimeters and the flaring angle of 42° while FIG. 6 shows the result of measurement in the horn unit according to the present invention with the diameter of 6 centimeters and the flaring angle of 80° in which the horns 1 and 2 are made of the exponential horn. In FIGS. 5 and 6, the ordinate indicates the absolute value of the output acoustic pressure in terms of dB while the abscissa indicates the frequency in terms of kHz. The output acoustic pressures in the respective horns were measured at the position of 0° taken on the central line of the horn and at the positions of angle of 30°, 60° taken relative to the central line, and the results of measurement are shown by three curves indicated by 0°, 30° and 60°. Thus, the horn unit according to the present invention provides the wide directional characteristics irrespective of the diameter as great as 6 centimeters, the directional characteristics being as wide as those of the conventional horn having the small diameter of about 3.5 centimeters.

We claim:

1. A horn unit for use in a speaker comprising a horn including a mouth, a throat, and a horn wall section connecting said throat and mouth, said horn wall section defining a linear longitudinal axis of the horn, said horn wall section having a continuous configuration which is formed in such a way that at least two curves having different flaring constants are connected with each other with the differential coefficients of the respective curves caused to substantially coincide with each other at the connecting point, and the curve near the mouth being so shaped that the flaring constant of the curve is greater than that of the curve near the throat, said curve at the mouth having a large flaring angle at least greater than 60°.

2. A horn unit for use in a speaker comprising a horn including a throat, a mouth, and a horn wall section connecting said throat and mouth, said horn wall section defining a linear longitudinal axis of the horn, said horn wall section being shaped in such a way that a first curve forming the configuration of said horn wall section at a portion extending from the throat to an area having a flaring angle within a range up to 35° is connected to a second curve forming the configuration of said horn wall section at a portion extending from the area having the flaring angle of up to 35° to the mouth and said second curve having a flaring constant different from that of the first mentioned curve with the differential coefficients of the respective flaring constants substantially coinciding at a point of connection, and wherein the flaring constant of the second curve at the mouth is made greater than that of the first curve at the throat with the flaring angle above 60° at the mouth.

3. A horn structure for use in a speaker having wide directional characteristics comprising a horn extending symmetrically along a linear longitudinal axis, said horn being formed with a throat portion and a mouth portion, said throat portion extending from a throat end symmetrically along said longitudinal axis with a first wall configuration determined by a first function, said first function providing a first curved wall configuration having a first increasing flaring angle with respect to the distance along said axis, said mouth portion extending to a mouth end symmetrically along said longitudinal axis with a second wall configuration determined by a second function, said second function providing a second curved wall configuration having a second increasing flaring angle with respect to the distance along said axis, said second increasing flaring angle being generally larger than said first increasing flaring angle, wherein said first and second increasing flaring angles are selected such that equiphase surfaces and constant acoustic pressure surfaces of an acoustic wave propagating along said axis are substantially matched, said throat and mouth portions being joined at a point of said first and second wall configurations wherein said first and second increasing flaring angles are substantially equal, and said mouth portion having a large flaring angle at said mouth end at least greater than 60° such that the reflection factor of the horn at the mouth end is reduced.

4. A horn structure according to claim 3, wherein said throat and mouth portions are separate portions being connected together at said point where said first and second increasing flaring angles are substantially equal.

5. A horn structure according to claim 3, wherein said throat and mouth portions are integrally formed together.

6. A horn structure according to claim 3, wherein said first increasing flaring angle ranges within 35°.

7. A horn structure according to claim 3, wherein said second increasing flaring angle is about 80° at said mouth end.

* * * * *